US006443371B1

(12) United States Patent
Arnfindsen

(10) Patent No.: US 6,443,371 B1
(45) Date of Patent: Sep. 3, 2002

(54) DEVICE FOR AUTOMATIC SPRAY APPLICATION OF PAINT

(75) Inventor: Ole Arnt Arnfindsen, Sandnes (NO)

(73) Assignee: ABB Flexible Automation A/S, Bryne (NO)

( * ) Notice: Subject to any disclaimer, the term of this patent is extended or adjusted under 35 U.S.C. 154(b) by 0 days.

(21) Appl. No.: 09/402,089

(22) PCT Filed: Mar. 23, 1998

(86) PCT No.: PCT/IB98/00421

§ 371 (c)(1),
(2), (4) Date: Nov. 2, 1999

(87) PCT Pub. No.: WO98/43744

PCT Pub. Date: Oct. 8, 1998

(30) Foreign Application Priority Data

Apr. 3, 1997 (SE) ..... 9701203

(51) Int. Cl.[7] ..... B05B 9/04
(52) U.S. Cl. ..... 239/373; 239/302
(58) Field of Search ..... 239/373, 342, 239/345, 302; 222/167, 169

(56) References Cited

U.S. PATENT DOCUMENTS 4,785,760 A 11/1988 Tholome
5,328,095 A * 7/1994 Wichenhaver ..... 239/373

FOREIGN PATENT DOCUMENTS

| | | |
|---|---|---|
| FR | 2635990 A1 | 3/1990 |
| JP | 7227556 | 8/1995 |
| SE | 504472 C2 | 2/1999 |

* cited by examiner

*Primary Examiner*—Lesley D. Morris
*Assistant Examiner*—Christopher Kim
(74) *Attorney, Agent, or Firm*—Connolly Bove Lodge & Hutz LLP

(57) ABSTRACT

A device for automatic spray application of paint through a spray nozzle comprises a container containing paint, arranged in the immediate proximity of the spray nozzle and connected to the spray nozzle through a conduit for supply of paint to the nozzle for spray application. The container is arranged rotatably, and the device comprises members adapted to drive the container to rotate for pressing paint contained therein outwardly towards a peripheral region of the container. The conduit has an opening in this region. An overpressure of a pressurized medium in the container for pressing paint out through the opening to the spray nozzle is provided.

21 Claims, 3 Drawing Sheets

DEVICE FOR AUTOMATIC SPRAY APPLICATION OF PAINT

FIELD OF THE INVENTION

The present invention relates to a device for automatic spray application of paint through a spray nozzle. The device comprises a container containing paint and arranged in the immediate proximity of the spray nozzle. The container is connected to the spray nozzle through a conduit for supplying paint thereto for spray application. The device further includes pressing means adapted to press the paint out of the container and through the conduit to the nozzle through a pressurized medium.

Such a device may have different fields of use, but for illustrating, but not in any way restricting the invention, the use of such a device for painting objects, such as vehicle bodies, through a spray painting robot will hereinafter primarily be discussed. Notwithstanding, the invention also comprises devices in the form of so called painting machines. "Paint" is here to be given a broad meaning and comprises all types of paints suited for spray application.

It is often desired to place such a container containing paint in spray application robots close to the spray nozzle to avoid long conduits between the source of paint and the spray nozzle. This is done primarily to avoid a great waste of paint when color is changed, but also to facilitate cleaning of such conduits and avoid having long conduits impede the ability to move the robot or otherwise constitute obstacles. However, a problem arises when the container is arranged close to the spray nozzle, if the container and the robot arm carrying the spray nozzle are moved so that the container is turned or tilted. The paint present in the container will, upon such movements of the container, assume a new position in the container through gravitation and may perhaps not be reachable by the conduit in this position, so that it will not be possible to spray paint out through the spray nozzle in certain positions of the robot arm, and thereby the container. Similarly, it may not be possible to efficiently discharge all the paint from the container should this be desired. Rather, the problem of supplying the spray nozzle with paint will instead increase with a decreasing content of paint in the container.

A solution to this problem is presented in FR 2 635 990, which consists of arranging a member for mechanically dividing the container inside the container for separating the paint and the pressurized medium, such as compressed air, in which this member is formed by a piston or a flexible membrane. However, an arrangement of such a membrane or piston in the container requires control means that are unnecessarily complicated and makes the construction of the container unnecessarily costly.

SUMMARY OF THE INVENTION

The object of the present invention is to provide a device of the type mentioned in the introduction, which solves the problem discussed above in a simpler, more advantageous and less costly way than has been achieved through the device according to the French publication mentioned above.

This object is obtained, according to the invention, by arranging the container to be rotatable and providing the device with members adapted to drive the container to rotate, for pressing paint contained therein outwardly towards a region of the periphery thereof. Further, the conduit has an opening in the peripheral region, and that the pressing means are adapted to establish an overpressure of the pressurized medium in the container for pressing paint out through the opening to the spray nozzle.

Thus, regardless of its positioning in the interior of the container, it may always be ensured that paint contained in the container is present where the conduit terminates in the container. Thus, paint may be supplied to the spray nozzle as long as there is any paint left in the container. This is achieved completely without any requirement of any membrane or piston inside the container. It is a matter of course that the driving member has to drive the container to rotate with such a speed that "the centrifugal force" keeps the paint against the periphery of the container. It is also within the scope of the invention that the driving member does not have to drive the container to rotate continuously, but this capability is present and utilized when needed. Thus, when spray is applied, for example, on any object with the spray nozzle and the container is in a fixed position during at least a period, rotating the container may be omitted should the container be positioned with the peripheral region at the lowest point, so that the gravitation keeps the paint close to the opening of the conduit. Furthermore, it is emphasized that "the pressing means are adapted to establish an overpressure of the pressurized medium in the container" is to be broadly interpreted and intended to comprise the case in which no real supply of pressurized medium to the container is provided. Rather, for example, the container may initially be filled by so much pressurized medium and pressurized medium of such a high pressure, besides the paint, that this pressurized medium is sufficient for obtaining pressing of all the paint out of the container during a pressure decrease, while maintaining an overpressure in the container when all the paint has been removed.

According to a preferred embodiment of the invention the opening of the conduit is located in the peripheral region at an inner wall of the container, so as to enable discharging of substantially all the paint contained in the container through the opening. A capability of completely emptying the container, with an optimum utilization of the volume thereof, is obtained due to such an arrangement of the opening of the conduit in combination with rotation of the container.

According to another preferred embodiment of the invention the peripheral region extends over a limited part of the extension of the container in a direction substantially in parallel with the axis for the rotation of the container. The opening does not thereby have to be given a disproportionately large extension in this direction so as to achieve an optimum emptying of paint to "the very last drop".

According to another preferred embodiment of the invention, which constitutes a further development of the embodiment last mentioned, the peripheral region is formed by a valley-like design of the container which is circumferential with respect to the axis of rotation of the container, and having a valley bottom with a maximum distance to the axis of rotation of the container, and wherein the opening is located in the valley bottom. A very well defined point for collection of the paint is obtained in this way, since the extension in the axial direction will be small due to this design, and the paint will move in the valley in a circumferential path and thereby be caught at a point by, or more exactly be pressed out through, the opening.

According to another preferred embodiment of the invention the container is substantially symmetrical with respect to the axis of rotation thereof. Such a design of the container is advantageous, since the paint thereby may be smoothly pressed outwardly towards the periphery of the container by the "centrifugal" force without any substantial formation of swirls or exerting shearing forces on the paint, which may degrade it. At the same time, a capability of even discharging of the paint from of the container is ensured.

According to another preferred embodiment of the invention the pressing means are adapted to press the paint out of the container through compressed air, which in most cases is to be preferred due to the ease of access to this pressurized medium.

According to another preferred embodiment of the invention the pressing means are adapted to supply the pressurized medium to a container in the region of the axis of rotation thereof. This is advantageous since the pressurized medium is then introduced into the space being free from paint at the rotation of the container, which improves the efficiency of the device, as well as because it is easier to fix the means with respect to rotation should this be desired. It also is easier to ensure the capability of removing the container from the means.

According to another preferred embodiment of the invention the device comprises a first valve member arranged in the conduit and a member adapted to control the valve member to open the conduit connection between the container and the spray nozzle when spray application of the paint is to be carried out and, when not, to close the valve member for preventing paint from leaving the container through the conduit. It is thereby ensured that paint is only sprayed out through the spray nozzle when this is really desired. This valve member may be arranged at any location along the conduit and may be located in the spray nozzle itself.

According to another preferred embodiment of the invention the conduit for discharging paint from the container comprises a tube extending from the region of the axis of rotation of the container outwardly towards the periphery of the container to the peripheral region for discharging paint from the container in this region and conducting the paint out of the container substantially along the axis of rotation of the container. By such an arrangement the paint may be efficiently directed out where this is easiest done, while an efficient "fetching" of paint from the container takes place.

According to another preferred embodiment of the invention, which constitutes a further development of the embodiment last mentioned, the device comprises a plurality of conduits extending into the peripheral region for discharging paint from the container at a plurality of locations distributed around the periphery of the container in the direction of rotation thereof. Each of the conduits is formed by a tube. Such a construction may be advantageous by increasing the efficiency of the delivery of paint from the container to the spray nozzle.

According to a further preferred embodiment of the invention the device comprises members for holding the container at a carrier close to the spray nozzle, and the holding members are adapted to hold the container releasably therefrom for removal thereof from the device for replacing it by another container, or filling the container with paint and then inserting it once again in the holding members. By arranging the container in this way, removably from the device, a replacement by a container filled with the same paint color or a container filled with a completely different paint color can occur as soon as the paint in the container in use is running out or a switch to another paint color is to take place. Thus, idle periods of the robot or the machine for spray application may be kept short. It will then be possible to clean and/or fill the container removed in peace and quiet.

Further advantages as well as advantageous features of the invention appear from the following description and the other dependent claims.

BRIEF DESCRIPTION OF THE DRAWINGS

With reference to the appended drawings, below follows a description of preferred embodiments of the invention cited as examples.

In the drawings.

DETAILED DESCRIPTION OF A PREFERRED EMBODIMENT OF THE INVENTION

Figure 1:
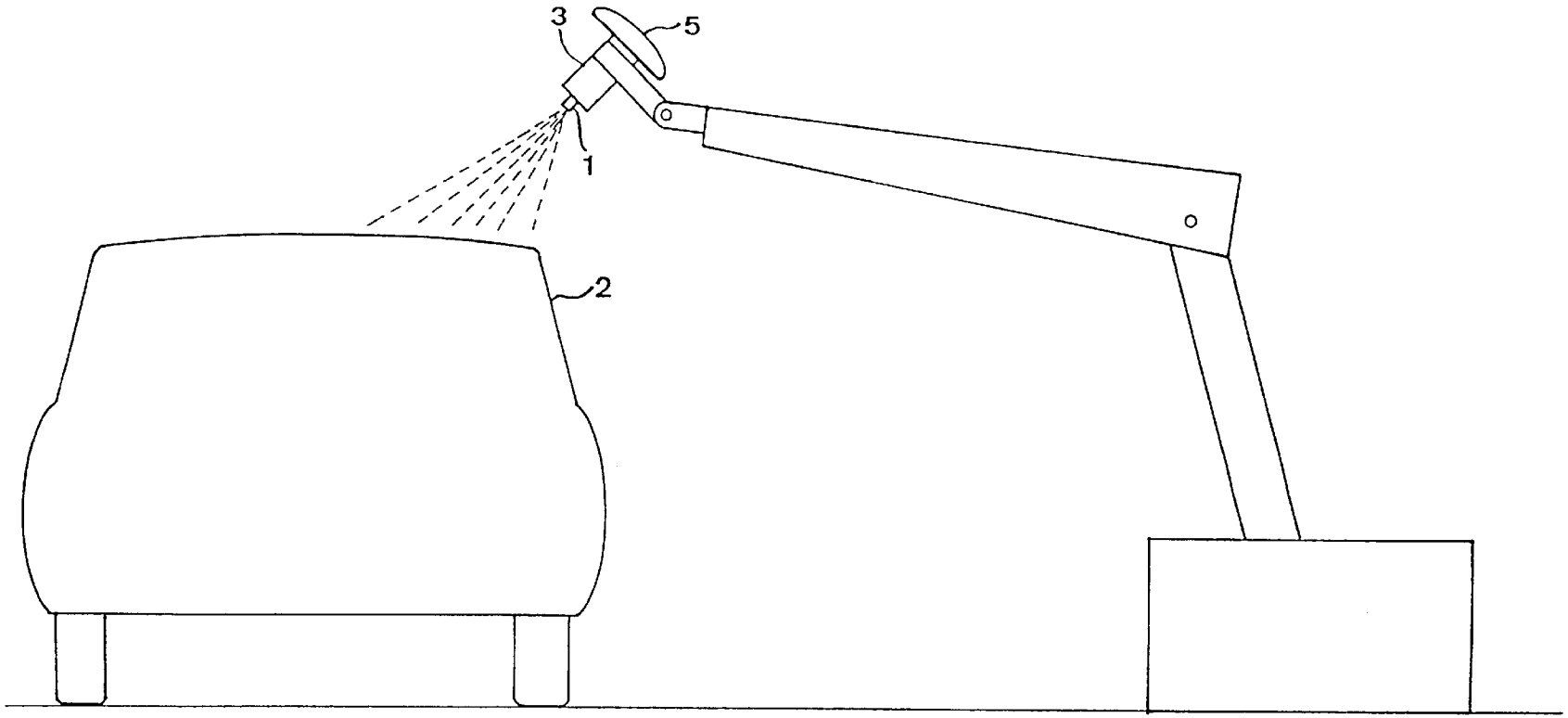
FIG. 1 is a schematic view of a robot for spray application of paint on a vehicle body, in which this robot is provided with a device according to a preferred embodiment of the invention.

A device for spray application of paint in the form of a spray painting robot, which has different robot arms hingedly connected to each other, is schematically illustrated in FIG. 1. On a robot arm a spray nozzle 1 in the form of a gun is arranged, but the nozzle may also be in the form of a bell, for spray application of atomized paint onto an object 2, here a vehicle body. The spray nozzle is connected to an arrangement 3 schematically indicated and adapted to atomize paint delivered to the spray nozzle 1 through a conduit 4 partially shown in FIG. 2, from a container 5 containing paint and arranged in the immediate proximity of the spray nozzle. Different conduits for, for example, supply of compressed air or electric control of parts included in the device have for the sake of simplicity been omitted in FIG. 1, and parts thereof having nothing to do with the invention have not been shown in the other Figures either.

Figures 2, 3:
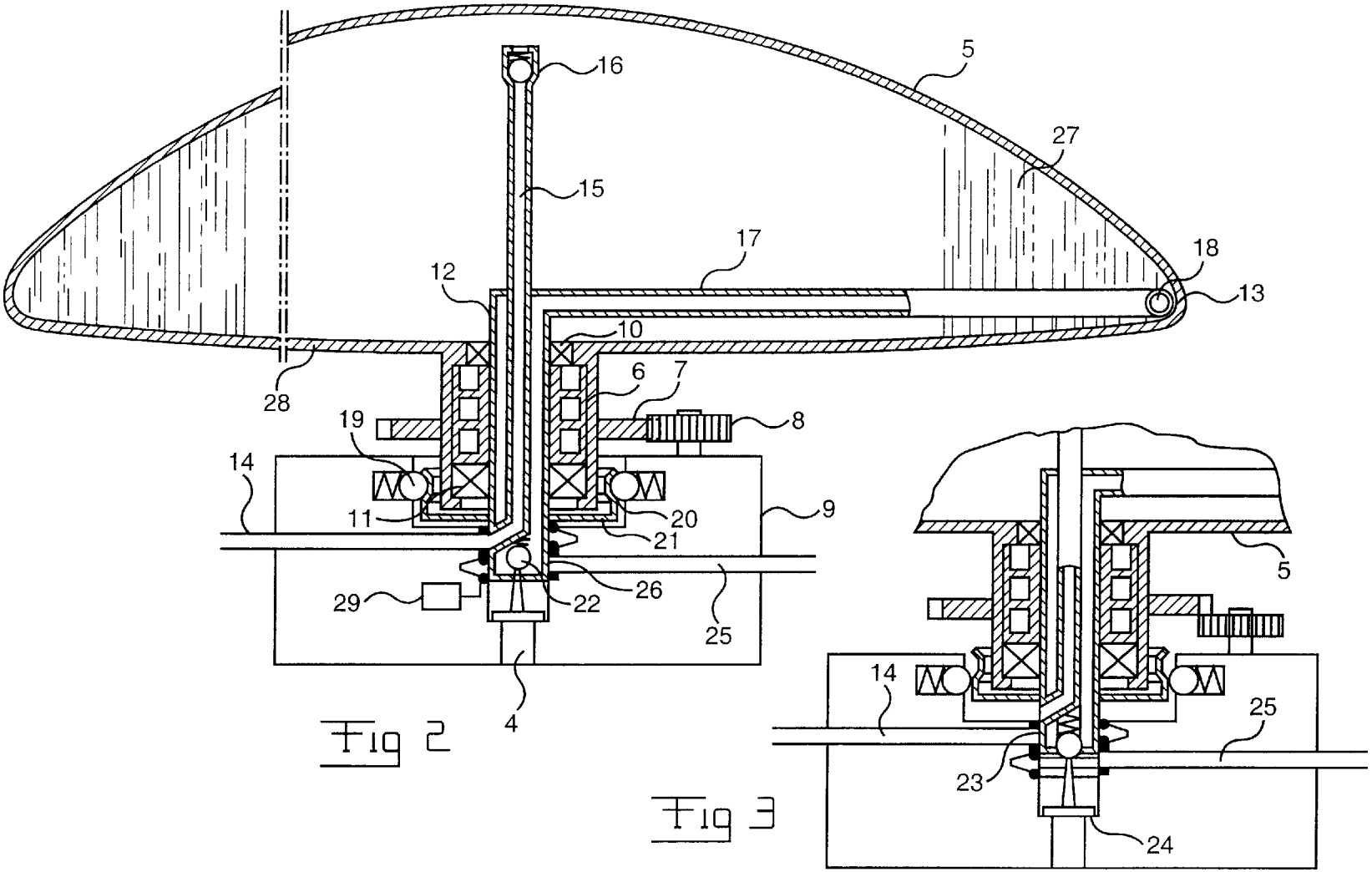
FIG. 2 is a view enlarged with respect to FIG. 1 and partially sectioned of the device indicated in FIG. 1.
FIG. 3 is a view corresponding to FIG. 2 of a part of the device shown in FIG. 2 in a position for removing the container therefrom and cleaning the spray nozzle.

Reference is now also made to FIG. 2. There it is shown that the container 5 has a mushroom hat-like appearance which is symmetrical with respect to rotation with elements 6 centrally projecting from the "mushroom hat" in parallel with the axis of symmetry, the elements 6 being provided with circumferential engagement members in the form of a gear 7. The gear 7 is in engagement with an engagement member in the form of a second gear 8 belonging to a member adapted to drive the container 5 to rotate about the symmetry axis thereof through rotating the gear 8 when desired in the spray application state of the device. The container is, for this reason, arranged rotatably with respect to a carrier 9, which may form a fixed part of the atomizing arrangement. It appears that the elements 6 of the container for this reason are rotatably journalled through bearings 10, 11 about a central part 12 arranged fixedly with respect to rotation with respect to the carrier 9 here and to be described more in detail further on.

The container 5 may be made of different types of material depending upon the intended use. When an electrically conducting paint of a high potential is applied, plastic having a good insulating capacity is a suitable material, but metal may also be possible for non-conducting paints. The container has a valley-like circumferential design with respect to the axis of rotation of the container with valley bottom 13 having a maximum distance to the axis of rotation of the container, so that paint present in the container will, upon rotation of the container, tend to run outwardly towards the valley bottom 13 for clearly defining a paint collecting point for the conduit 4 (see further on).

The device has also a means for supply of compressed air comprising a conduit 14 having a tube portion 15 extending centrally into the container and being provided with a non return valve 16 at the extremity thereof. Furthermore, the conduit 4 comprises, between the container and the spray nozzle, a tube 17 extending close to the axis of rotation of the container and then bent substantially radially outwardly and having an opening 18 at the periphery of the container in the valley bottom 13 for receiving paint from the container. The tube portion 15 and the tube 17 form the central part 12, which is non-rotatably arranged and about which the container is intended to be brought to rotate. In an alternative embodiment it is also possible to arrange this part rotatably should that be desired. Furthermore, the device comprises members 19, here in the form of spring loaded balls, forced into engagement with recesses 20 of a part 21 rigidly connected to the part having the tubes 15 and 17. Thus, the central part and the container may be removed together from the container 9 by lifting them in the way illustrated in FIG. 3, but the container is preferably also separable from the central part and held to the central part by holding members not shown, so that it is possible to only remove the container should that be desired.

The device has also a first valve member 22 schematically indicated and arranged in the conduit 4 so as to open and close, respectively, the communication between the container and the spray nozzle. This valve member is shown in an open position in FIG. 2 and in a closed position in FIG. 3. A plate 24 provided with a number of holes is arranged downstream of the valve member in the conduit 4 for spreading the paint. A second valve member is arranged in the conduit 14 for supply of pressurized medium and it is schematically illustrated in FIG. 3 how this valve member 23 closes the supply conduit, while it keeps this conduit open for supply of compressed air to the container in FIG. 2. A control member 29 controls the second valve member to open and close, respectively, the communication between the source of pressurized medium and the containers. It is also possible that the container has an auxiliary valve arranged in the container for filling paint or compressed air. Finally, the carrier 9 has a conduit 25 feeding into the conduit 4 for supplying a cleaning medium, such as compressed air or a solvent, for cleaning the conduit 4 from the mouth of the conduit 25 therein and downstream to the spray nozzle. A valve member 26 is also located here for keeping this conduit 25 closed during spray application of paint through the device.

The function of the device described above is as follows. When paint is to be sprayed out through the nozzle the container 5 is brought to rotate by driving the second gear 8 to rotate. Preferably, the container is then rotated so that the paint is subjected to a centripetal acceleration $V^2/r$=about 3 g (g=the gravitation), which will result in a pressing of the paint 27 outwardly as far as possible away from the axis of rotation of the container and accordingly towards the valley bottom 13. It may be a certain advantage to use a container having a comparatively small radius, since the velocity at the periphery of the container will be lowered by a factor 4 upon halving the radius, which reduces the shearing forces upon the paint and prevents it from being destroyed, primarily by formation of aggregates.

The paint, by rotation of the container, will always be located at the periphery thereof irrespective of the position of the container as a consequence of movements of the robot arm during spray application onto different surfaces of the object to be painted. The compressed air supplied centrally to the container will tend to press out the paint through the opening 18 of the conduit 4 in a region (valley bottom 13) where paint is always present as long as there is any paint at all in the container. Thus, compressed air is supplied through the conduit 14 in the position shown in FIG. 2, and the valve member 22 for flow of paint to the spray nozzle is also open, while the valve member 26 is closed.

It is illustrated in FIG. 3 how the container may be lifted away for filling with a new paint and/or cleaning thereof. In the position shown in FIG. 3 the valve members 23 and 22 have for the rest closed the respective conduit portions, while the valve member 26 has opened the communication between the conduit 25 and the conduit 4, so that the cleaning medium may now be supplied to the conduit 4 for cleaning thereof and the spray nozzle through the conduit 25. Furthermore, the container may advantageously have an auxiliary valve arranged in the wall thereof, for example at 28, enabling a blowing out of an optional amount of air from the container upon paint filling, so that the container may be filled substantially completely with paint.

Figure 4:
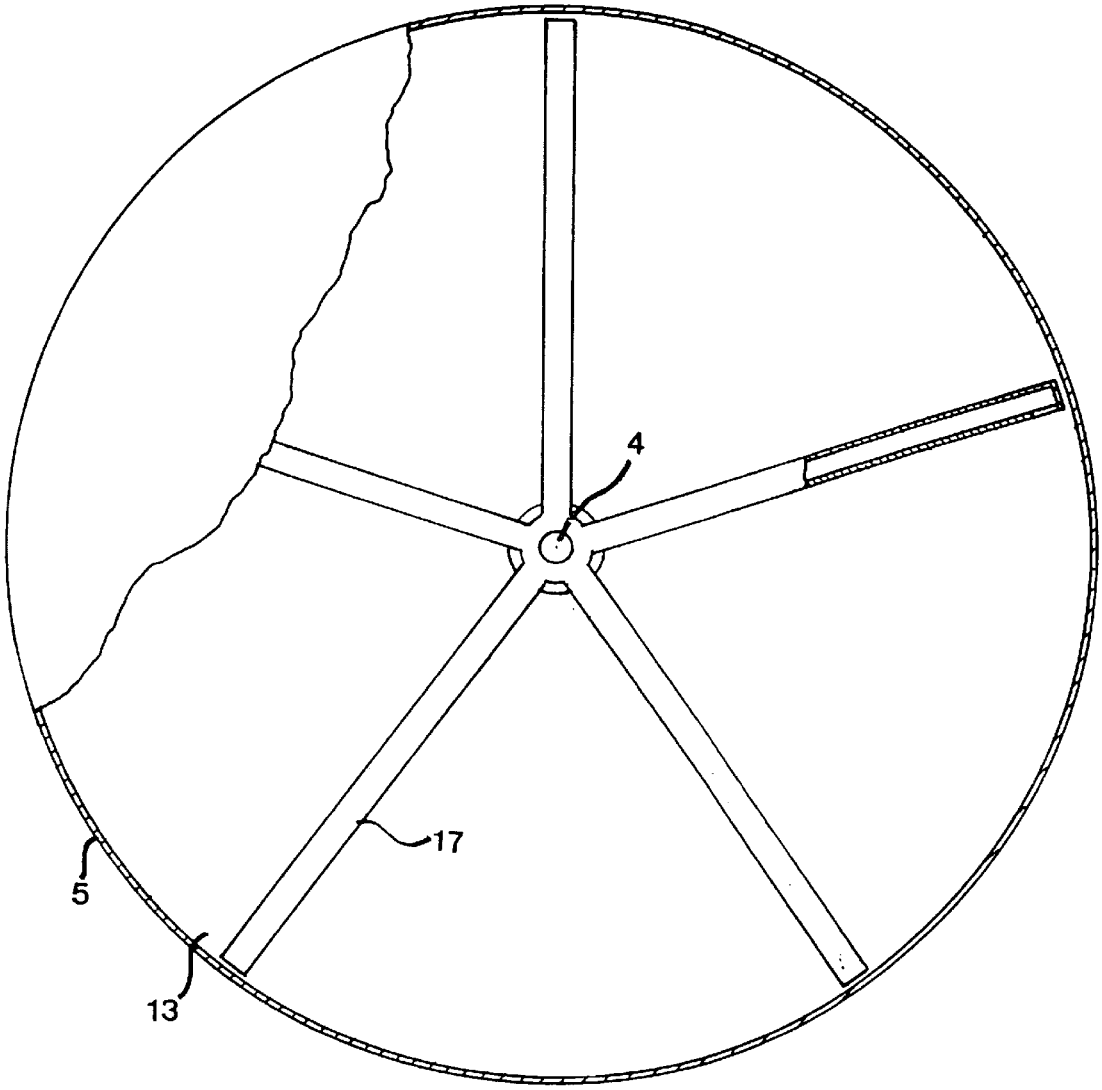
FIG. 4 is a partially sectioned view from above of a part of a device according to an alternative embodiment of the invention.

A container 5 of a device according to a further embodiment of the invention is shown in FIG. 4. In this embodiment a plurality of tubes 17 extending into the region 13 for discharging paint from the container are arranged at a plurality of locations distributed around the periphery of the container. The tubes converge close to the axis of rotation of the container into a common conduit 4 extending to the spray nozzle. This may increase the efficiency of the delivery of paint from the container to the spray nozzle.

The invention is of course not in any way restricted to the preferred embodiment described above, but many possibilities to modifications thereof will be apparent to a man skilled in the art without departing from the basic idea of the invention.

The shape of the container may, for example, be different. Two possible shapes are a ball shape, which, however, does not make the collecting point as clearly defined as in the case shown above having the very accentuated valley bottom, and a discus shape, which results in a collecting point being very well defined. As already mentioned, the container may be provided with compressed air having a pressure of, for example, 5 bars initially, followed by no compressed air being supplied. The pressure may then fall to 2 bars when all the paint has been discharged from the container.

What is claimed is:

1. A device for automatic spray application of paint through a spray nozzle, which comprises a container arranged in the immediate proximity of the spray nozzle, said container being connected through a conduit to the spray nozzle for supplying paint thereto and further comprising means for pressing the paint out of the container and through said conduit to the nozzle through a pressurized medium, wherein the container is rotatable and wherein the device further comprises members for spinning the container about an axis of rotation through the container thereby pressing paint contained therein outwardly towards a peripheral region of the container, wherein said conduit has an opening located in said peripheral region, and wherein said means establish an overpressure of said pressurized medium in the container for pressing paint out through said opening to the spray nozzle.

2. A device according to claim 1, wherein said opening of the conduit is located in said region at an inner wall of the container so as to enable discharging of substantially all the paint contained in the container through said opening.

3. A device according to claim 1 wherein said peripheral region is part of an extension of the container in a direction substantially in parallel with said axis for rotation of the container.

4. A device according to claim 3, wherein said peripheral region is formed by a valley-like portion of the container, said portion being circumferential with respect to the axis of rotation of the container and having a bottom with a maximum distance to the axis of rotation of the container, and wherein said opening is located in said bottom.

5. A device according to claim 1, wherein the container is substantially symmetrical with respect to the axis of rotation.

6. A device according to any of claim 1, wherein said pressurized medium comprises compressed air.

7. A device according to claim 1, wherein said device further comprises a source of pressurized medium for supplying said pressurized medium into the interior of the container.

8. A device according to claim 7, wherein said means supply the pressurized medium to the container adjacent an axis of rotation thereof.

9. A device according to claim 1, further comprising a first valve member arranged in said conduit and a member for controlling the valve member to open the conduit connection between the container and the spray nozzle when spray application of the paint is to be carried out and, for closing the valve member to prevent paint from leaving the container through the conduit.

10. A device according to claim 7, further comprising a second valve member arranged in a conduit for supply of pressurized medium from said source to the container and a member for controlling the second valve member to open and close, respectively, communication between the source of pressurized medium and the container.

11. A device according to claim 1, wherein said conduit for discharging paint from the container comprises a tube extending from the region of the axis of rotation of the container outwardly toward the periphery of the container to said peripheral region for discharging paint from the container in said peripheral region and conducting the paint out of the container substantially along the axis of rotation of the container.

12. A device according to claim 11, comprising a plurality of conduits extending into said peripheral region for discharging paint from the container at a plurality of locations distributed around the periphery of the container in the direction of rotation thereof, each of the conduits being formed by a tube.

13. A device according to claim 12, wherein each of said tubes converge close to the axis of rotation of the container into a common conduit extending to the spray nozzle.

14. A device according to claim 1, further comprising holding members for holding the container at a carrier close to the spray nozzle, and wherein the holding members hold the container releasably for removal thereof from the device for replacing it by another container or filling the container with palm and then inserting it once again in the holding members.

15. A device according to claim 2, wherein said region is part of an extension of the container in a direction substantially in parallel with the axis of rotation of the container.

16. A device according to claim 2, wherein the container is substantially symmetrical with respect to the axis of rotation thereof.

17. A device according to claim 3, wherein the container is substantially symmetrical with respect to the axis of rotation thereof.

18. A device according to claim 4, wherein the container is substantially symmetrical with respect to the axis of rotation thereof.

19. A device according to claim 2, wherein said means are adapted to press the paint out of the container through the compressed air.

20. A device according to claim 3, wherein said means are adapted to press the paint out of the container through the compressed air.

21. A device according to claim 1, wherein the container is spun about an axis through the spray nozzle of the container.

* * * * *